US005901855A

United States Patent [19]

Uno et al.

[11] Patent Number: 5,901,855

[45] Date of Patent: May 11, 1999

[54] METHOD AND APPARATUS FOR SORTING AND REARRANGING MAILS IN SEQUENCE SORTING

[75] Inventors: Kaori Uno, Aichi-ken; Akihiro Kawaoka, Owariasahi, both of Japan

[73] Assignee: Hitachi, Ltd., Tokyo, Japan

[21] Appl. No.: 08/814,772

[22] Filed: Mar. 10, 1997

[30] Foreign Application Priority Data

Mar. 11, 1996 [JP] Japan ..... 8-052824

[51] Int. Cl.[6] ..... B07C 5/00

[52] U.S. Cl. ..... 209/584; 209/900; 235/375

[58] Field of Search ..... 209/583, 584, 209/900; 235/379, 380, 381, 382, 375

[56] References Cited

U.S. PATENT DOCUMENTS

| | | | |
|---|---|---|---|
| 5,353,938 | 10/1994 | LaGrange et al. | 209/584 |
| 5,363,971 | 11/1994 | Weeks et al. | 209/900 X |
| 5,421,464 | 6/1995 | Gillmann et al. | 209/584 |
| 5,493,106 | 2/1996 | Hunter | 235/375 |

FOREIGN PATENT DOCUMENTS

| | | | |
|---|---|---|---|
| 533536 | 3/1993 | European Pat. Off. | 209/584 |
| 69208789 | 3/1993 | Germany . | |
| 4302231 | 8/1994 | Germany . | |
| B2-3-18952 | of 0000 | Japan . | |
| B2-61-14878 | of 0000 | Japan . | |

*Primary Examiner*—Tuan N. Nguyen
*Attorney, Agent, or Firm*—Antonelli, Terry, Stout & Kraus, LLP

[57] ABSTRACT

An apparatus for sorting and rearranging mails in the sequence sorting is disclosed, in which a multiplicity of mails are loaded in a sorter controlled by a computer to cause the sorter to perform a plurality of sorting passes. A delivery information list has recorded therein the delivery information including the sequence sorting and addresses. A serial number list has stored therein two-digit serial numbers including first-order digit of serial numbers for the first sorting pass and second-order digits of the serial numbers for the second sorting pass set in the sequence sorting corresponding to the delivery information list. A recognition unit recognizes the address of each of the mails loaded in the sorter and sorted in the order of the first-order digit of the serial number. A number-of-mails matrix table records the number of mails by the address recognized in the recognition unit in the first sorting pass. Before the sorting operation by the second-order digit, the second-order digit of the serial number is reassigned based on the number-of-mails matrix table to prevent the overflow at any bins or stackers during the sorting operation by the second-order digit. Then, the mails sorted by the first-order digit are loaded in the sorter in the order of the particular serial number to perform the sorting operation in accordance with the reassigned second-order digit of the serial number.

15 Claims, 12 Drawing Sheets

FIG.2

| 10 | | | | 15 | | | |
|---|---|---|---|---|---|---|---|
| 11 | 12 | 13 | 14 | 17 | 16 | 18 | 19 | 20 |
| DELIVERY AREA | SEQUENCE SORTING | ADDRESS | ADDRESS CODE | SERIAL NUMBER | | | SERIAL NUMBER OF CALCULATED BINS OR STACKERS | SERIAL NUMBER OF OVERFLOW BINS OR STACKERS |
| | | | | FIRST-ORDER DIGIT | SECOND-ORDER DIGIT | | | |
| 1 | 1 | NO.1, NIJIGAOKA 1-1,AOBA-KU | 21512341-1-1 | | | | | |
| 1 | 2 | NO.2, NIJIGAOKA 1-2,AOBA-KU | 21512341-2-2 | | | | | |
| 1 | 3 | NO.2, NIJIGAOKA 1-2,AOBA-KU | 21512341-2-1 | | | | | |
| ... | ... | ... | ... | | | | | |
| 2 | 22 | NO.1, SUSUKINO 1-3,AOBA-KU | 21556781-3-1 | | | | | |
| ... | ... | ... | ... | | | | | |
| 5 | 88 | NO.4, FUJINODAI 11-5,AOBA-KU | 215111211-5-4 | | | | | |
| 5 | 89 | NO.4, FUJINODAI 11-2,AOBA-KU | 215111211-2-3 | | | | | |
| 5 | 90 | NO.4, FUJINODAI 11-2,AOBA-KU | 215111211-2-5 | | | | | |
| ... | ... | ... | ... | | | | | |
| 5 | 93 | NO.2, TAHATA 3-4,AOBA-KU | 21594723-4-2 | | | | | |
| ... | ... | ... | ... | | | | | |
| 5 | 99 | NO.2, TAHATA 5-6,AOBA-KU | 21598765-6-5 | | | | | |
| 5 | 100 | NO.2, TAHATA 5-7,AOBA-KU | 21598765-7-1 | | | | | |

FIG.3

10

| 11 DELIVERY AREA | 12 SEQUENCE SORTING | 13 ADDRESS | 14 ADDRESS CODE |
|---|---|---|---|
| 1 | 1 | NO.1, NIJIGAOKA 1-1,AOBA-KU | 21512341-1-1 |
| 1 | 2 | NO.2, NIJIGAOKA 1-2,AOBA-KU | 21512341-2-2 |
| 1 | 3 | NO.2, NIJIGAOKA 1-2,AOBA-KU | 21512341-2-1 |
| ... | ... | ... | ... |
| 2 | 22 | NO.1, SUSUKINO 1-3,AOBA-KU | 21556781-3-1 |
| ... | ... | ... | ... |
| 5 | 88 | NO.4, FUJINODAI 11-5,AOBA-KU | 215111211-5-4 |
| 5 | 89 | NO.4, FUJINODAI 11-2,AOBA-KU | 215111211-2-3 |
| 5 | 90 | NO.4, FUJINODAI 11-2,AOBA-KU | 215111211-2-5 |
| ... | ... | ... | ... |
| 5 | 93 | NO.2, TAHATA 3-4,AOBA-KU | 21594723-4-2 |
| ... | ... | ... | ... |
| 5 | 99 | NO.2, TAHATA 5-6,AOBA-KU | 21598765-6-5 |
| 5 | 100 | NO.2, TAHATA 5-7,AOBA-KU | 21598765-7-1 |

15

| 17 16 18 SERIAL NUMBER | | 19 | 20 |
|---|---|---|---|
| FIRST-ORDER DIGIT | SECOND-ORDER DIGIT | SERIAL NUMBER OF CALCULATED BINS OR STACKERS | SERIAL NUMBER OF OVERFLOW BINS OR STACKERS |
| 1 | 1 | | |
| 2 | 1 | | |
| 3 | 1 | | |
| ... | ... | | |
| 2 | 3 | | |
| ... | ... | | |
| 8 | 9 | | |
| 9 | 9 | | |
| 10 | 9 | | |
| ... | ... | | |
| 3 | 10 | | |
| ... | ... | | |
| 9 | 10 | | |
| 10 | 10 | | |

FIG.4

10 15

| 11 DELIVERY AREA | 12 SEQUENCE SORTING | 13 ADDRESS | 14 ADDRESS CODE | 17 SERIAL NUMBER FIRST-ORDER DIGIT | 16 SERIAL NUMBER SECOND-ORDER DIGIT | 18 | 19 SERIAL NUMBER OF CALCULATED BINS OR STACKERS | 20 SERIAL NUMBER OF OVERFLOW BINS OR STACKERS |
|---|---|---|---|---|---|---|---|---|
| 1 | 1 | NO.1, NIJIGAOKA 1-1,AOBA-KU | 21512341-1-1 | 1 | 1 | | 1 | |
| 1 | 2 | NO.2, NIJIGAOKA 1-2,AOBA-KU | 21512341-2-2 | 2 | 1 | | 1 | |
| 1 | 3 | NO.2, NIJIGAOKA 1-2,AOBA-KU | 21512341-2-1 | 3 | 1 | | 1 | |
| ... | ... | ... | ... | ... | ... | | ... | |
| 2 | 22 | NO.1, SUSUKINO 1-3,AOBA-KU | 21556781-3-1 | 2 | 3 | | 5 | |
| ... | ... | ... | ... | ... | ... | | ... | |
| 5 | 88 | NO.4, FUJINODAI 11-5,AOBA-KU | 215111211-5-4 | 8 | 9 | | 16 | |
| 5 | 89 | NO.4, FUJINODAI 11-2,AOBA-KU | 215111211-2-3 | 9 | 9 | | 17 | |
| 5 | 90 | NO.4, FUJINODAI 11-2,AOBA-KU | 215111211-2-5 | 10 | 9 | | 17 | |
| ... | ... | ... | ... | ... | ... | | ... | |
| 5 | 93 | NO.2, TAHATA 3-4,AOBA-KU | 21594723-4-2 | 3 | 10 | | 18 | |
| ... | ... | ... | ... | ... | ... | | ... | |
| 5 | 99 | NO.2, TAHATA 5-6,AOBA-KU | 21598765-6-5 | 9 | 10 | | 18 | |
| 5 | 100 | NO.2, TAHATA 5-7,AOBA-KU | 21598765-7-1 | 10 | 10 | | 19 | |

FIG.5

10

| 11 DELIVERY AREA | 12 SEQUENCE SORTING | 13 ADDRESS | 14 ADDRESS CODE |
|---|---|---|---|
| 1 | 1 | NO.1, NIJIGAOKA 1-1,AOBA-KU | 21512341-1-1 |
| 1 | 2 | NO.2, NIJIGAOKA 1-2,AOBA-KU | 21512341-2-2 |
| 1 | 3 | NO.2, NIJIGAOKA 1-2,AOBA-KU | 21512341-2-1 |
| ... | ... | ... | ... |
| 2 | 22 | NO.1, SUSUKINO 1-3,AOBA-KU | 21556781-3-1 |
| ... | ... | ... | ... |
| 5 | 88 | NO.4, FUJINODAI 11-5,AOBA-KU | 215111211-5-4 |
| 5 | 89 | NO.4, FUJINODAI 11-2,AOBA-KU | 215111211-2-3 |
| 5 | 90 | NO.4, FUJINODAI 11-2,AOBA-KU | 215111211-2-5 |
| ... | ... | ... | ... |
| 5 | 93 | NO.2, TAHATA 3-4,AOBA-KU | 21594723-4-2 |
| ... | ... | ... | ... |
| 5 | 99 | NO.2, TAHATA 5-6,AOBA-KU | 21598765-6-5 |
| 5 | 100 | NO.2, TAHATA 5-7,AOBA-KU | 21598765-7-1 |

15

| 17 SERIAL NUMBER: FIRST-ORDER DIGIT | 16 SERIAL NUMBER: SECOND-ORDER DIGIT | 18 | 19 SERIAL NUMBER OF CALCULATED BINS OR STACKERS | 20 SERIAL NUMBER OF OVERFLOW BINS OR STACKERS |
|---|---|---|---|---|
| 1 | 1 | | 1 | — |
| 2 | 1 | | 1 | — |
| 3 | 1 | | 1 | — |
| ... | ... | | ... | — |
| 2 | 3 | | 5 | — |
| ... | ... | | ... | — |
| 8 | 9 | | 16 | — |
| 9 | 9 | | 17 | OB1 |
| 10 | 9 | | 17 | OB2 |
| ... | ... | | ... | OB1 |
| 3 | 10 | | 18 | OB1 |
| ... | ... | | ... | OB1 |
| 9 | 10 | | 18 | OB1 |
| 10 | 10 | | 19 | OB2 |

OB1,OB2 : OVERFLOW BINS OR STACKERS

METHOD AND APPARATUS FOR SORTING AND REARRANGING MAILS IN SEQUENCE SORTING

BACKGROUND OF THE INVENTION

The present invention relates to a method and an apparatus for sorting mails by destination address and rearranging them in sequence sorting.

The mail processing is roughly divided into the dispatch sorting work and the delivery sorting work. The dispatch sorting work is the one in which mails received are sorted by the destination area in the post office. The delivery sorting work, on the other hand, is the one in which mails for delivery are sorted by the territory of each postman and rearranged by the postman in the sequence sorting in the particular territory.

A most portion of sequence sorting has conventionally been performed manually and represents a large proportion of the postmen's work time. Demand is now high for improving the efficiency of the delivery sorting work, i.e., for mechanization and automation of the entire delivery sorting work including sequence sorting.

With the aim of eliminating the conventional manual work, an information mechanization plan is going on for improving the mail process by introducing a new postal code (ZIP code) system. Specifically, address described on mails are read and corresponding address codes are printed on the mails. For delivery sorting and sequence sorting, the sorter reads the address code printed on each mail and thus automatically sorts the mails. As a result, more detailed sorting by machine than the current sorting system becomes possible for delivery. In this way, all the sorting work for delivery including sequence sorting can be mechanized theoretically.

The prior art related to the above-mentioned techniques are disclosed in JP-B2-3-18952 and JP-B2-61-14878.

In the technique disclosed in JP-B2-3-18952, each of paper items (mails) carries an indication representing a plurality of high and low hierarchical sorting levels. Mails in stages of high-level sorting are sorted by a radial sorting system, and mails in stages of low-level sorting are sorted by a rearrangement sorting system. Consequently, the mails are sorted a lesser number of times, and even in the case where the sorter goes out of order during the sorting operation, the result of sorting already completed remains unaffected and can be effectively utilized to continue subsequent sorting work.

The system disclosed in JP-B2-61-14878, on the other hand, concerns the technique in which mails are sorted according to an indication carried thereon representing a plurality of coarse and fine sorting levels. In the coarse sorting, the number of all the mails processed is stored by destination area in a memory. On the basis of this information, the mails addressed to given areas, which have been processed and are fewer than a predetermined number, are stacked in the same deposit section in the fine sorting stage. As a result, the number of mails in each deposit section can be averaged out thereby facilitating the mailing work.

As described with reference to the prior art above, several methods are available for rearranging data using the computer. Generally, however, the cardinal number sorting method is well known. The cardinal number sorting method accomplished in two levels will be described below. In this method, mails are rearranged by number based on the same principle as the conventional rearrangement sorting system.

Assume that mails carrying two-digit numbers are rearranged by the number. In the first pass, mails are sorted by the first-order digit. In other words, mails having the same least-significant digit are singled out. In the second pass, the mails rearranged in the first pass are applied in that order through the sorter. The mails are thus sorted and rearranged by the second-order digit of the number. In this way, all the mails to be sorted can be arranged according to the two-digit numbers.

In the cardinal number sorting method described above in which mails are rearranged in two sorting passes, however, some mails sorted in the second pass may overflow. In other words, mails may be stacked in some bin or stacker beyond their capacity. In such a case, extra mails that have overflown are stacked in a collective deposit section. These extra mails are disrupted in order, thereby making the first-pass sorting useless.

SUMMARY OF THE INVENTION

In view of the above-mentioned situation, the object of the present invention is to obviate the above-mentioned problems of the conventional techniques and provide a method and an apparatus for sorting and rearranging mails in the sequence sorting, in which even in the case where mails sorted by the cardinal number sorting method develop an overflow after a plurality of passes of sorting work, the sorting efforts up to the immediately preceding pass are saved.

According to the present invention, there is provided a method of sorting and rearranging mails in the sequence sorting in a plurality of sorting passes using a sorter controlled by a computer, comprising the steps of preparing a serial number list for storing serial numbers used in the first sorting pass, serial numbers for second and subsequent sorting passes, serial numbers for the primary bins or stackers and serial numbers for overflow, each corresponding to the delivery information having at least delivery areas, the sequence sorting, addresses and address codes, assigning serial numbers of two or more digits in order to maintain the sequence sorting in the serial number list, preparing a number-of-mails check matrix table including first-order digits of serial numbers for the first sorting pass and second and higher order digits for the second and subsequent sorting passes used for checking the total number of mails, attaching a mark at a position in the matrix table corresponding to the serial number of each mail read, calculating the total number of mails for each number in each order of digit marked in the number-of-mails check matrix table, determining a required number of bins or stackers for each number of the last digit, determining the total number of bins or stackers required for each number of the last digit, reassigning the number of the secondary bins or stackers in the serial number list, assigning overflow serial numbers in the serial number list by determining the optimum number of mails resorted to the overflow, and reassigning the serial numbers for the sorting pass corresponding to the last digit in a manner to prevent an overflow.

In a method and an apparatus for sorting and rearranging mails in the sequence sorting according to the present invention, a matrix table (a number-of-mails check matrix table) including the bin or stacker numbers of the first-order digits and the bin or stacker numbers of the second and subsequent order digits for checking the total number of mails is used to prepare a serial number list, in which the serial numbers of the normal bins or stackers and the serial numbers of overflow bins or stackers used in case of an overflow can be indicated in correspondence with the delivery information including the delivery area, the sequence sorting, the address and the address code, so that the serial numbers for the last sorting pass are reassigned, thereby preventing an overflow.

BRIEF DESCRIPTION OF THE DRAWINGS

FIG. 2 is a first diagram showing a delivery area information list 10 and a serial number list 15 according to an embodiment.

FIG. 3 is a second diagram showing a delivery area information list 10 and a serial number list 15 according to an embodiment.

FIG. 4 is a third diagram showing a delivery area information list 10 and a serial number list 15 according to an embodiment.

FIG. 5 is a fourth diagram showing a delivery area information list 10 and a serial number list 15 according to an embodiment.

DESCRIPTION OF THE PREFERRED EMBODIMENTS

An embodiment of the invention will be described with reference to the accompanying drawings.

Figure 1:
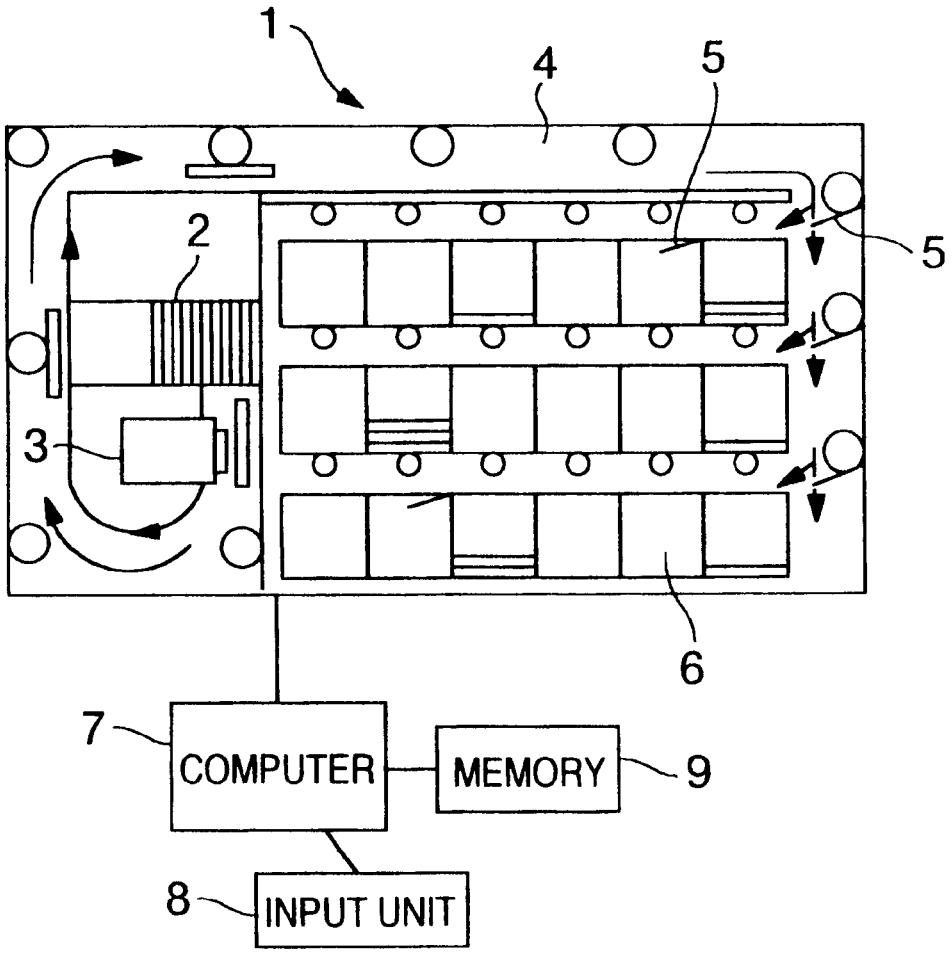
FIG. 1 is a block diagram showing a configuration of an apparatus for sorting and rearranging mails in the sequence sorting according to an embodiment of the invention.

FIG. 1 is a block diagram showing a configuration of an apparatus for sorting and rearranging mails in the sequence sorting according to an embodiment of the invention. In FIG. 1, reference numeral 1 designates a sorter including a loading port 2, a recognition section 3, a conveyor 4, a distribution gate 5 and a plurality of bins or stackers 6. The mails to be sorted in the sorter 1 are loaded vertically into the loading port 2 and forced rightward. The mails located at the right end of the loading port 2 are moved downward by the conveyor belt, and the address of each mail is read in the recognition section 3. The mail that has passed the recognition section 3 is moved along the direction of arrows by the conveyor 4. A computer 7 has the function of a controller for controlling the overall operation of the sorter 1. The computer 7 thus controls the operation of the distribution gate 5 for distributing the mails into different directions of conveyance according to the address read in the recognition section 2.

According to the embodiment shown in FIG. 1, there are a total of 18 bins or stackers 6 arranged in three rows of six. A small conveyor belt (not shown) is arranged at a corresponding position above each bin or stacker 6 for conveying the mails leftward over the rows of bins or stackers. A select gate (not shown) is arranged between the small conveyor belts, and the sorter is so configured that each select gate can introduce mails into each bin or stacker 6 under the control of the computer 7.

An input unit 8 is used for supplying information on the configuration of the sorter including the number and arrangement of the bins or stackers, the bin or stacker number and the total number of mails that can be held in each bin or stacker, and also for setting a sorting mode including the dispatch sorting and the delivery sorting. A memory unit 9 is used for storing a list and a table or an operation program described later.

FIGS. 2, 3, 4 and 5 are diagrams showing the delivery information and the corresponding serial numbers. With reference to these drawings, an example will be explained in which mails are rearranged in two sorting passes using the cardinal number sorting method.

In FIG. 2, a delivery information list 10, which is stored in the memory unit 9 in advance, contains information including a delivery area 11, a delivery order 12, an address 13 and an address code 14. The serial number list 15, on the other hand, has set therein two-digit serial numbers 16 corresponding to the delivery area information list 10. FIG. 2, however, shows the state in which the actual information has yet to be filled in the serial number list. The two-digit serial numbers are used in order to perform the sorting operation on the first digit in the first sorting pass and the sorting operation on the second digit in the second sorting pass, so that the rearrangement operation may be completed in two sorting passes.

FIG. 3 shows the state in which the numerical values of the digits 17 and 18 are set for the two-digit serial numbers 16. The numeral in each digit may not be one digit but may include a plurality of digits. In the example shown in FIG. 3, numerals 1 to 10 are used. In this case, therefore, the number of destination households is equal to the product 100 of the maximum values of each digit.

With reference to FIG. 4, in the case where mails are sorted by the first digits of the serial number 17, as described later, the actual number of mails is counted for each serial number 16 in the number-of-mails check matrix table described later, and each bin or stacker is reassigned with a serial number of in accordance with the total number of mails indicated for each serial number 16. The resulting number is set again as the calculated serial number 19 of each bin or stacker.

In the case where the calculated number of bins or stackers indicated by the calculated serial number 19 of the bins or stackers in FIG. 4 is smaller than the actual number of bins or stackers (18 bins or stackers in the embodiment of FIG. 1) available in the sorter 1, all mails to be sorted can be sorted in accordance with the calculated serial numbers of bins or stackers. In the case where the calculated number of bins or stackers is larger, on the other hand, a part of the calculated serial numbers of bins or stackers cannot be assigned to an actual bin or stacker. In such a case, as described later, a serial number 20 for overflowing bins or stackers is assigned as shown in FIG. 5. In this way, the bins or stackers actually used for successful sorting and the overflowing bins or stackers can be clearly defined separate from each other.

Figure 6:
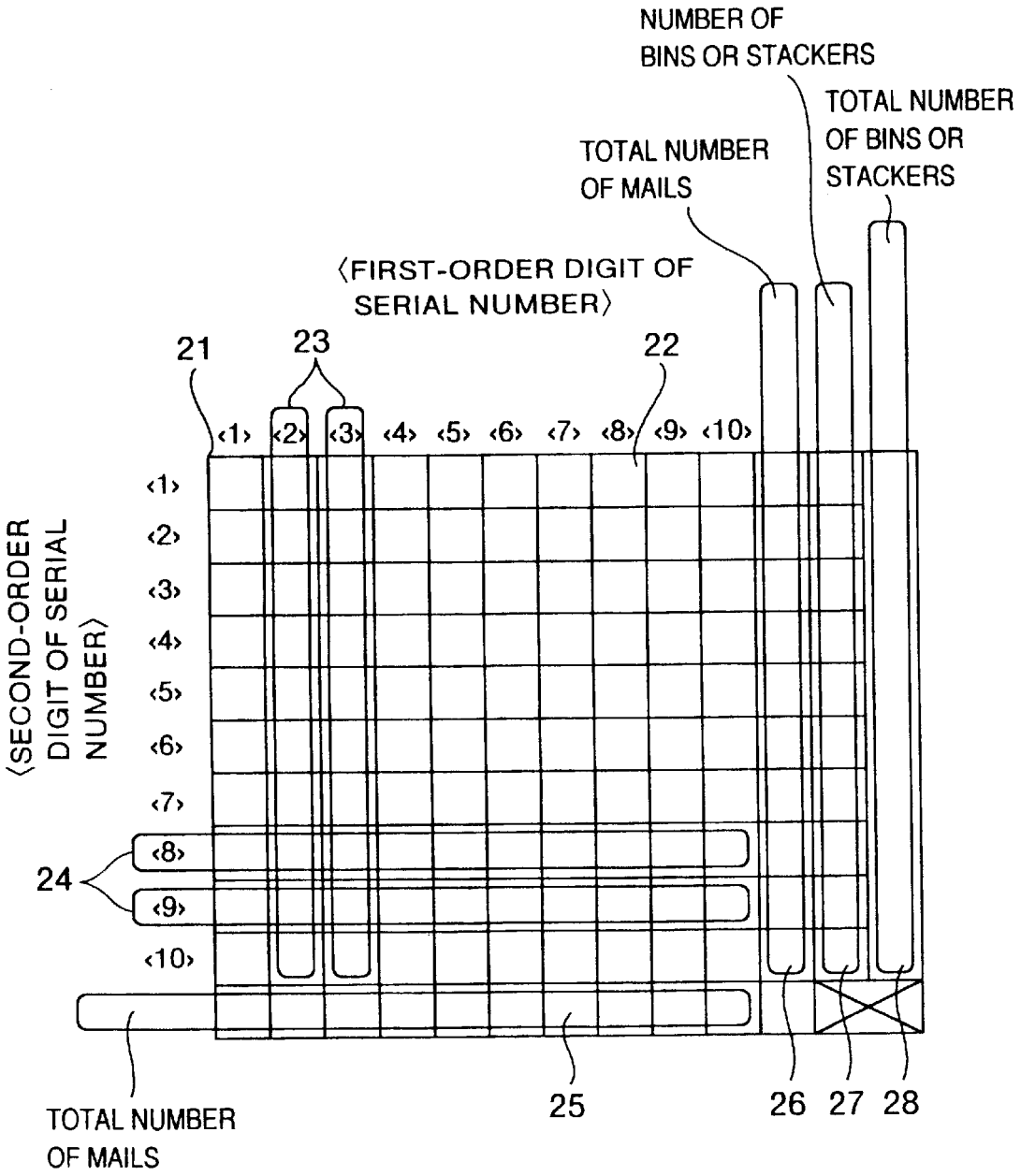
FIG. 6 is a first diagram showing a number-of-mails check matrix table according to an embodiment.
Figure 7:
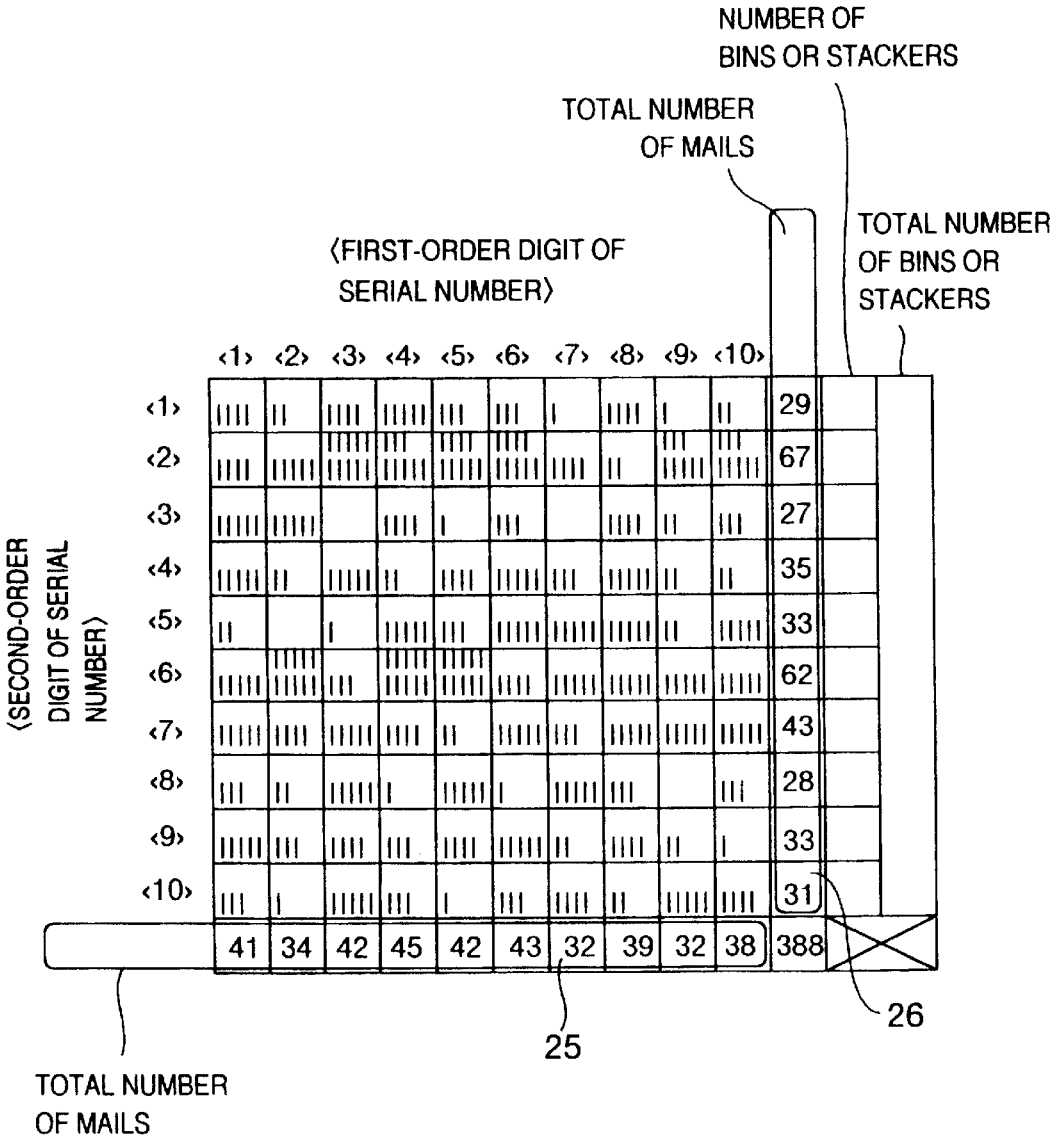
FIG. 7 is a second diagram showing a number-of-mails check matrix table according to an embodiment.
Figure 8:
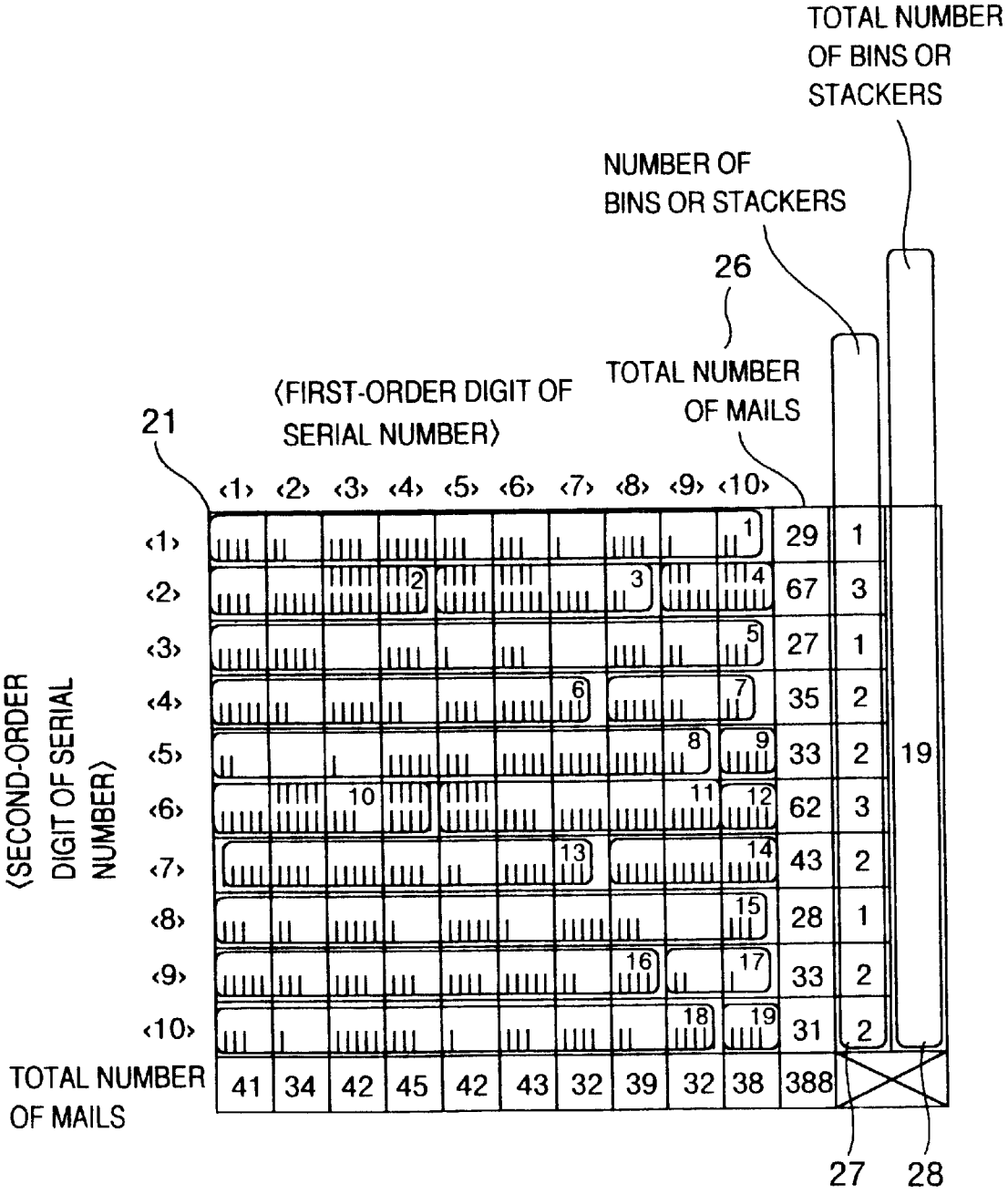
FIG. 8 is a third diagram showing a number-of-mails check matrix table according to an embodiment.

FIGS. 6, 7 and 8 designate a configuration of the number-of-mails check matrix table 21. FIG. 6 shows the matrix table in which nothing is written before mails are checked. The number-of-mails check matrix table 21 has a checkered pattern, i.e., a matrix pattern in which the first-order digits of the serial number 17 in the serial number 16 shown in FIG. 3 are set on the abscissa, and the second-order digits of the serial number 18 are set along the ordinate. Each frame element of the checker corresponds to each destination household. In the case where the first-order digit is "8" and the second-order digit is "1" in the serial number of a mail, for example, the count is recorded at position 22 in FIG. 6. FIG. 7 shows the state in which the total number of mails is counted for each serial number including the first and second digits by checking the actual serial numbers of mails to be sorted in this manner. In FIG. 7, the total number columns 25 and 16 represent the total number of mails for each of the first-order and second-order digits of the serial number. The grand total number of mails is indicated at the intersection of the longitudinal and lateral column strips of the numbers of mails in first-order and second-order digits, respectively. The number-of-mails check matrix table is not necessarily in matrix, but may assume a three-dimensional table, for example, in the case where mails are sorted in three passes using the cardinal number sorting method.

The number-of-mails check matrix table 21 shown in FIG. 7 is prepared in the manner described below.

First, a mail is loaded by way of the loading port 2. The assignment of the bin or stacker 6 for the first-order digit of the serial number is input from the input unit 8. Upon starting the sorting operation for the first digits, the recognition section 3 recognizes the address. The result of recognition is converted into a serial number in the computer 7. A count mark is attached at a position corresponding to the serial number thus converted in the number-of-mails check matrix table 21 stored in the memory unit 9. Each mail thus is distributed among bins or stackers corresponding to the first-order digit of the serial number thereof. Upon complete check of all the mails in this way, the number-of-mails check matrix table 21 as shown in FIG. 7 is formed.

During the process of mail distribution according to the first-order digit described above, assume that any one of the bins or stackers is filled up or nearly filled up. Then, the mails assigned to the particular bin or stacker are separated, automatically or by the operation of an attendant, on the side of the sorter 1 and stacked there in a manner not to mix with the mails in other bins or stackers.

Upon complete distribution work for the first-order digits, mails are recovered from each bin or stacker automatically or manually, loaded into the sorter in the ascending order of the first-order digit and then sorted according to the second-order digit of the serial number. As a result, mails are rearranged and stacked at each bin or stacker in the order of the second-order digit of the serial number. The mails are recovered from each bin or stacker in the ascending order of the second-order digits of the serial number. In this way, all the mails can be rearranged in the order of serial number.

Assume that a maximum of 30 mails can be accommodated in each bin or stacker. Mails may overflow from some bins or stackers during the sorting operation based on the second-order digit. Normally, the mails that have overflown are introduced to a spare overflow bin or stacker and stacked there. In the case where an overflow occurs in a plurality of bins or stackers, therefore, the mails stacked in the overflow bin or stacker are in an disrupted order of sequence.

With reference to FIG. 8, according to the present invention, in the case where a number-of-mails column 26 for the second-order digit of the serial number has more than 30 mails, for example, the number of bins or stackers for the particular column is increased to reduce the number of mails to 30 or less in each bin or stacker. For the column associated with the second-order digit of "1", for example, the total number of mails is 29 which is not more than 30, and therefore, only one bin or stacker is provided. For the column corresponding to the second-order digit of "2", on the other hand, the total number of mails is 67 which is more than 30. The number of mails in each cell is added sequentially from the left to right, and defined in a range not exceeding 30. Then, frames 2, 3 and 4 are obtained as shown in the drawing, indicating three bins or stackers. The number of bins or stackers is determined subsequently in similar fashion, and the number of bins or stackers shown in FIG. 8 is reached. The total of these numbers of bins or stackers is tantamount to 19, which is recorded in the column 28 indicating the total number of bins or stackers required. In other words, 19 bins or stackers are known to be required for the second-order digit sorting operation (second sorting pass).

In the case where the total number of required bins or stackers is smaller than the actual number of bins or stackers, the actual bins or stackers are assigned in a manner determined in the bin or stacker number column 27 in FIG. 8. Then, the sorting operation for the second-order digit can be executed without any overflow. In the case where the total number of required bin or stacker is greater than the actual number of bins or stackers, on the other hand, the difference constitutes the number by which the bins or stackers are deficient. The number of overflow bins or stackers is obtained by adding the numbers of mails in each bin or stacker sequentially backward from the number of mails in the last bin or stacker and dividing the sum by 30 with the remainder carried to the next higher order. The number by which the bins or stackers is reduced, therefore, can be obtained by subtracting the number of overflow bins or stackers from the number of bins or stackers involved in the add operation. The add and divide operation is executed until the difference becomes equal to the deficient number of bins or stackers, and when the difference in number of the bins or stackers becomes equal to the deficient number of bins or stackers, all the bins or stackers added in the add operation is considered the overflow bins or stackers. Specifically, in the case of FIG. 8, the calculated number of bins or stackers is 19 while the actual number of bins or stackers is 18. The deficient number of bins or stackers, therefore, is 1. Add the number 4 in the last bin or stacker 19, the number 26 for the immediately preceding bin or stacker and the number 3 for the second preceding bin or stacker. The total number of mails for the three bins or stackers is "33", which is divided by 30 and fractions below decimal point are raised to a unit. Then, the number "2" is obtained. In this way, the three calculated bins or stackers 17 to 19 can be reduced to two. Consequently, the calculated bins or stackers 1 to 16 are used directly as actual bins or stackers, and the mails assigned to the calculated bins or stackers 17 to 19 are sent into the 17th to 18th bins or stackers constituting overflow bins or stackers.

The operation according to the invention based on the flowcharts of FIGS. 9A and 9B will be explained with reference to the delivery area information list 10 and the serial number list 15 in FIG. 5 and the number-of-mails check matrix table 21 in FIG. 8.

Figure 9A:
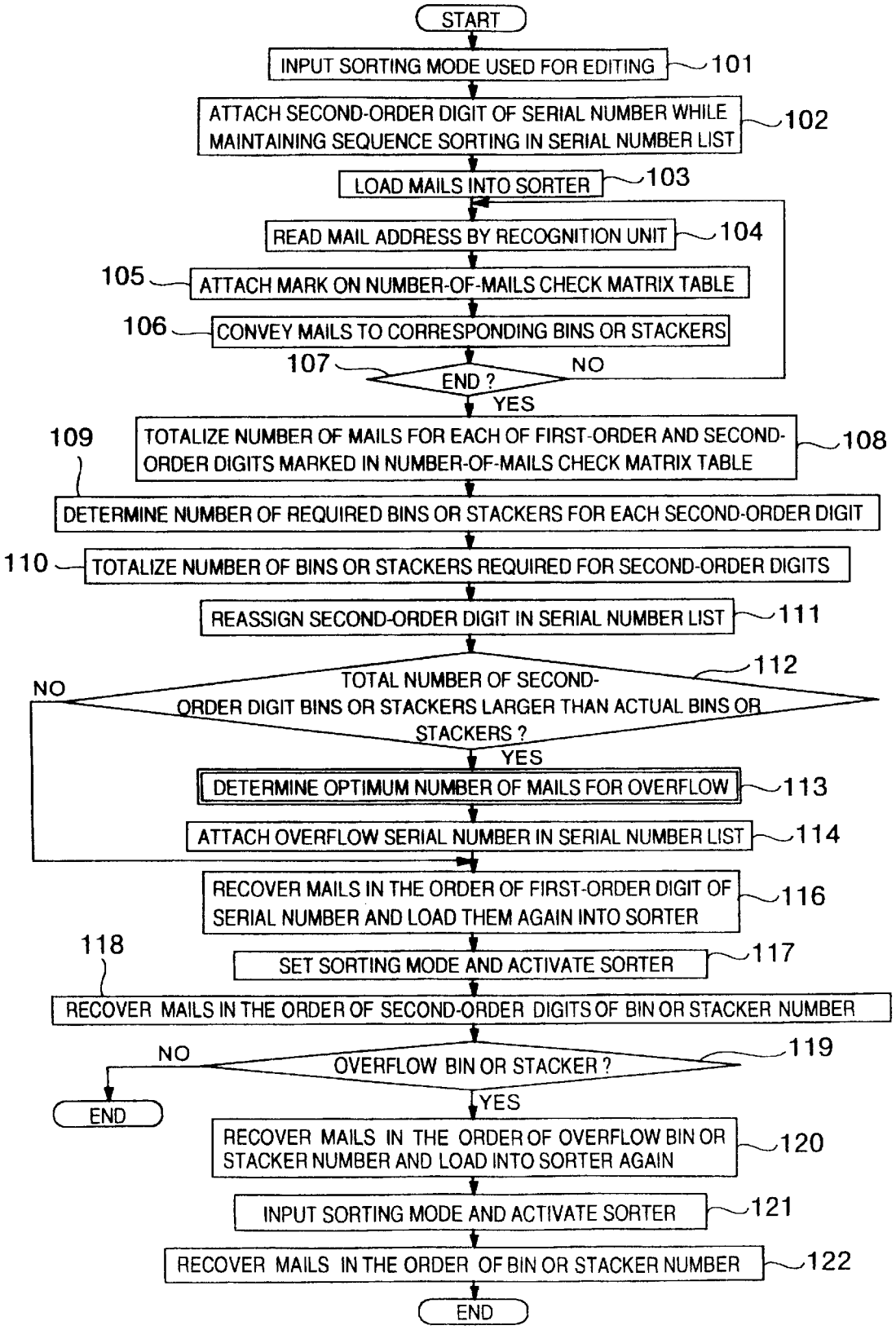
FIGS. 9A and 9B are flowcharts for explaining the operation of processing an overflow.
Figure 9B:
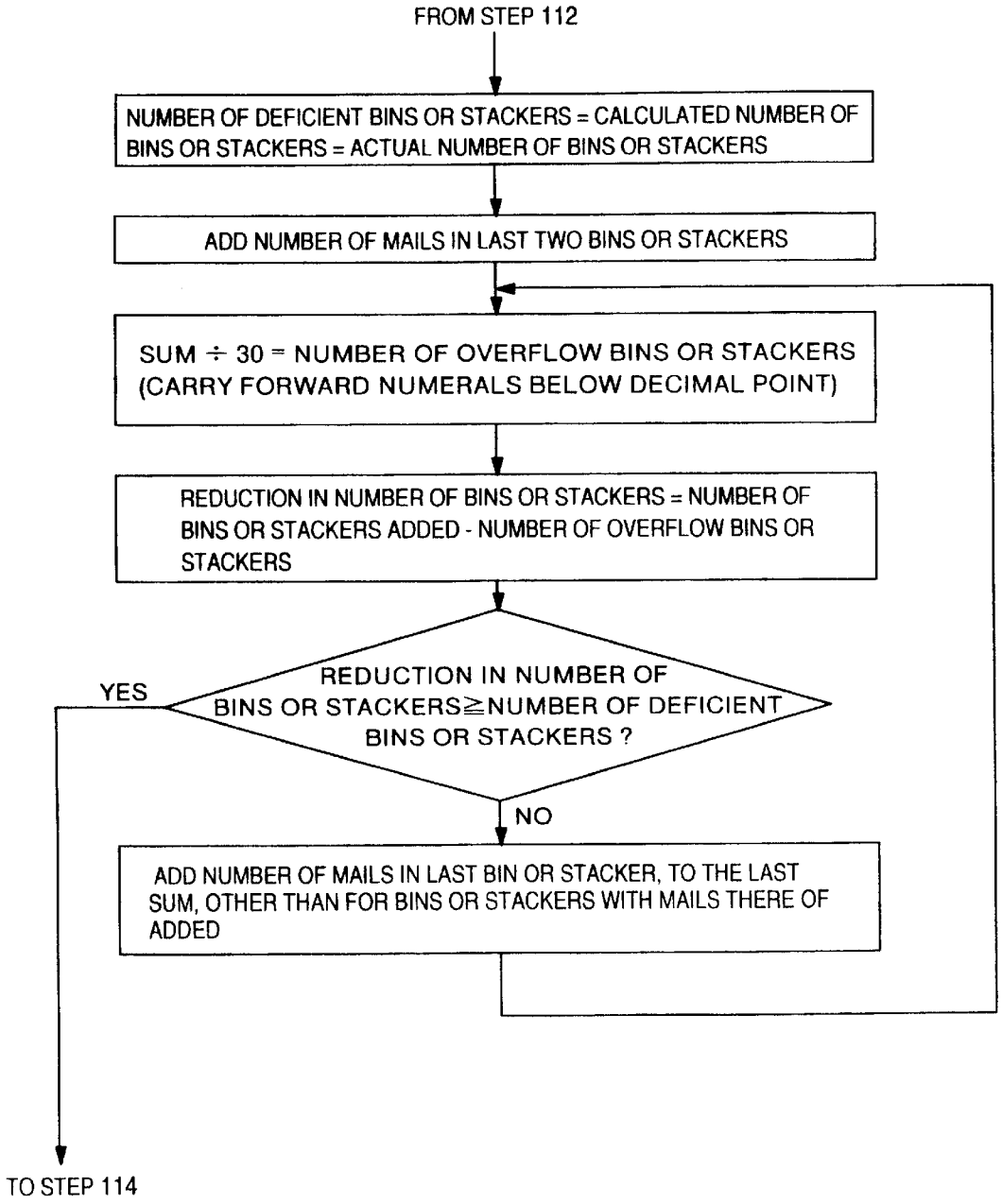

FIGS. 9A and 9B are flowcharts showing the operation of the computer 7 of FIG. 1. These operation flowcharts are intended to prevent the overflow by reassigning the serial numbers of the bins or stackers when rearranging the mails in the sequence sorting. By way of explanation, assume that the sorter 1 has 18 bins or stackers, the maximum number of mails that can be accommodated in a single bin or stacker is 30, the number of delivery areas is 5 and the number of households to which the mails are to be delivered is 100.

The operation flow of FIG. 9A is started, and step 101 inputs a sorting mode from the input unit 8, which is the delivery area mode in this case covering the delivery areas 1 to 5. As a result, the delivery area information list 10 as shown in FIG. 2 is read out. Then, step 102 sets the two-digit serial numbers 16 as shown in FIG. 3 in such a manner as to complete the process of mail rearrangement for delivery in two sorting passes while maintaining the sequence sorting specified in the delivery area information list 10. Since the number of destination households involved is 100, the serial numbers 16 include digits 1 to 10 each in the first order 17 and the second order 18. The first-order digits of the serial number constitute the bin or stacker number for the first sorting pass, and the second-order digits of the serial number make up the bin or stacker number for the second sorting pass.

In step 103, mails to be sorted are loaded, and as the sorter starts operating, in step 104, the recognition section 3 reads the address of each mail and searches the serial numbers 16. At the same time, the sorting operation is executed on the first-order digits. Step 105 records a count mark at a corresponding position of the serial number in the number-of-mails check matrix table 21 shown in FIG. 6. Then, the mail is conveyed to the bin or stacker corresponding to the first-order digit of the serial number.

Steps 107 decides whether or not the mails are absent in the loading port by means of a mail detection sensor, for example. In the case where the decision is NO, the process returns to step 104 for repeating the operations of steps 104 to 107 described above.

In the case where the decision in step 107 is YES, on the other hand, step 108 calculates and records the total number of mails for each of the first-order digit column and the second-order digit column in the total number columns 25 and 26, respectively, of the number-of-mails check matrix table 21 shown in FIG. 7. Step 109 proceeds to assign the bin or stacker numbers 1 to 19 sequentially as shown in FIG. 8 in a manner for each frame not to contain more than 30 mails for each second-digit column of the serial number. The number of bins or stackers for each second-order digit thus is calculated and recorded in the bin or stacker number column 27. Step 110 calculates the total number of bins or stackers recorded in the bin or stacker number column 27 and records it in the total bin or stacker number column 28.

Now, step 111 rewrites the second-order digits of the serial numbers 18 of FIG. 5 to the ones as shown in the calculated bin or stacker serial number column 19 in FIG. 4 in accordance with the bin or stacker numbers 1 to 19 shown in FIG. 8 determined in step 109. This step corresponds to reassignment of the second-order digit serial numbers 18 in the serial number list 15 in such a manner as to prevent an overflow.

Then, step 112 compares the value "19" in the column 28 indicating the total number of second-order digit bins or stackers with the actual number "18" of bins or stackers, and decides whether the former is larger than the latter. If the decision is NO, the process would proceed to the next step of sorting based on the second-order digits. Since the decision is YES, however, it indicates that the actual number of bins or stackers is deficient. The process therefore proceeds to step 113 where the bin or stacker numbers are assigned in descending order from the largest bin or stacker number "19" to the overflow bins or stackers until the reduction in the calculated number of bins or stackers becomes equal to the actual number of deficient bins or stackers. The optimum number of mails applied to overflow thus is determined. The specific operation of step 113 is shown in more detail in the flowchart of FIG. 9B. The specific operation shown in FIG. 9B will be readily understood from the foregoing description and will not be explained again. As a result of the operation in step 113, the optimum number of mails assigned for overflow is the final sum determined. Consequently, mails can be accommodated in the actual bins or stackers without any overflow, and the optimum number of overflow bins or stackers can be determined. In step 114, the overflow bins or stackers determined in this way are recorded in the numbers OB1, OB2 for discriminating the overflow bins or stackers in the serial number column 20 in FIG. 5.

Figure 10:
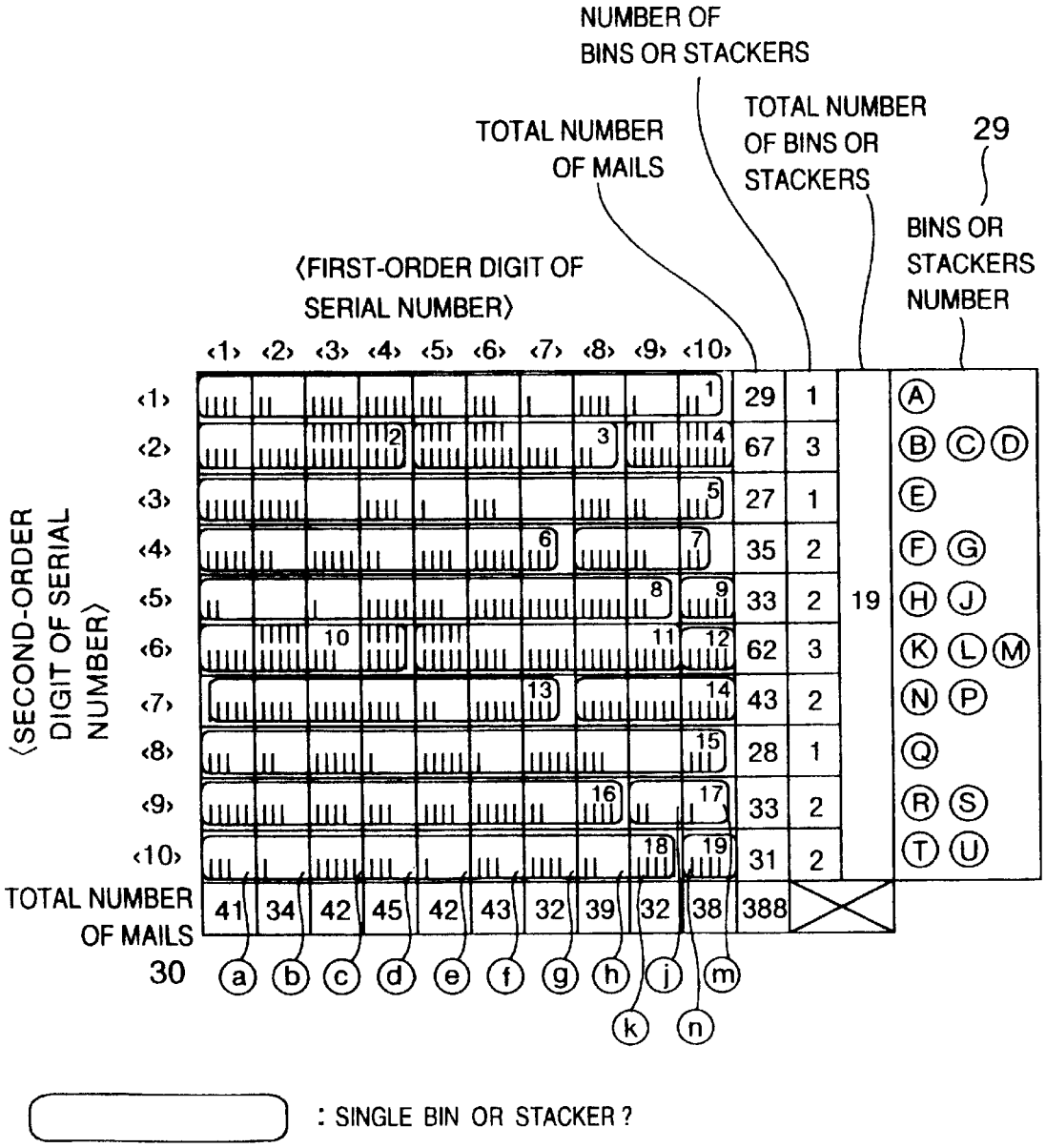
FIG. 10 is a fourth diagram showing a number-of-mails check matrix table according to an embodiment.
Figure 11:
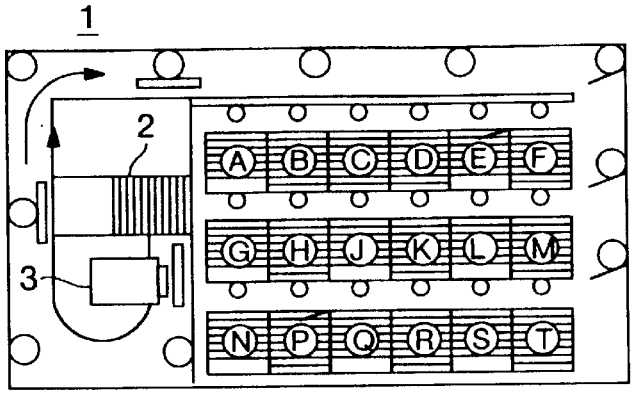
FIG. 11 is a first diagram for explaining the bin or stacker assignment.
Figure 12:
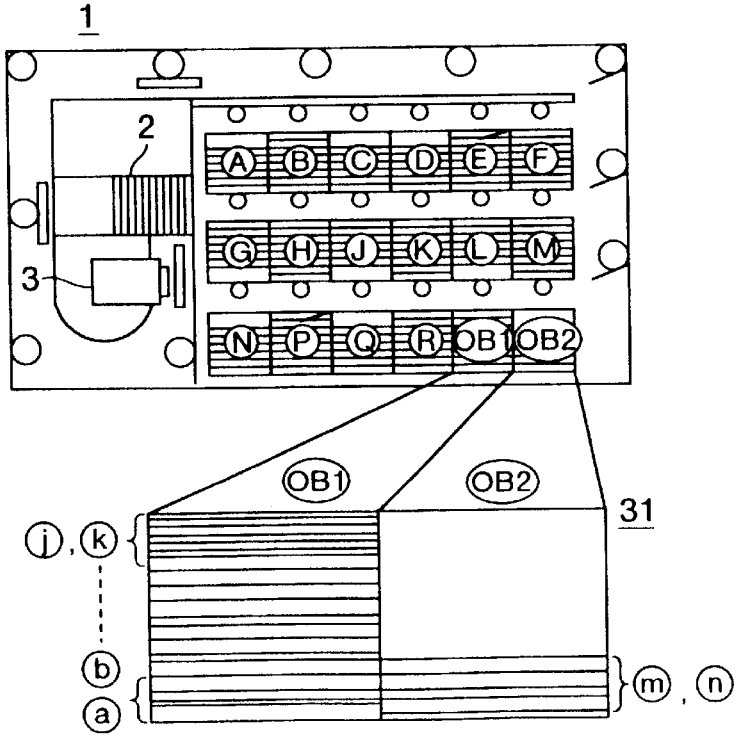
FIG. 12 is a second diagram for explaining the bin or stacker assignment.

Consequently, assuming that the calculated bins or stackers 1 to 19 are indicated as A to U as shown in the bin or stacker number column of FIG. 10, the bins or stackers are assigned in a manner corresponding to FIG. 11. In this case, however, one bin or stacker is deficient. Therefore, as shown in FIG. 12, the calculated bins or stackers 1 to 16 are directly assigned to the actual bins or stackers A to R, while the calculated bins or stackers 17 to 19 are assigned to the overflow bins or stackers OB1 to OB2.

Now, explanation will be made about the manner in which the overflow numbers OB1, OB2 are assigned. The sorting operation based on first-order digits from step 101 to the positive decision in step 107 accumulates the mails corresponding to the first-order digits of the serial number in each of the bins or stackers of the bin or stacker numbers 1 to 10. According to this embodiment, 41, 34, 42 mails and so on, are stacked, respectively, for the first-order digits 1, 2, 3 and so on, of the serial number, as shown in FIG. 8. In the case where more than 30 mails are expected to accumulate for the first-digits 1, 2 and 3 of the serial number, the mails stacked before reaching 30 are separated from the respective bins or stackers and placed on the side of the particular bins or stackers automatically or manually. In this way, masses of mails are piled in the order of the first-order digit of the serial number. In the operation of distributing the mails according to the second-order digits of the serial number, on the other hand, the mails sorted according to the first-order digit of the serial numbers are loaded into the sorter 1 in ascending order of the first-order digits. The mails corresponding to the calculated bins or stackers 17 to 19, therefore, are introduced to the overflow bins or stackers in the order of serial numbers 1-10 (a), 2-10 (b), . . . , 8-10(h), 9-9(j) and 9-10(k), 10-9(m) and 10-10(n). As shown in the serial number list 15, therefore, the number of mails is added in the order of introduction to the overflow bins or stackers, so that 28 mails up to the first-digit 9 of the serial number not exceeding 30 mails are introduced to the overflow bin or stacker OB1. The mails belonging to serial numbers 10-9(m) and 10-10(n) are thus introduced to the overflow bin or stacker OB2. As a result, the mails to be assigned to the calculated bins or stackers 17 to 19 are distributed between the overflow bins or stackers OB1 and OB2. As shown in the overflow bin or stacker 31 in enlarged view in the lower portion of FIG. 12, mails a to k shown in FIG. 10 are sequentially stacked in the overflow bin or stacker OB1, while mails m and n are stacked in the other overflow bin or stacker OB2. Since the mails i, k and mails m, n belong to the serial numbers of the same first-order digit, they are stacked in the same mixed state as distributed by the first-order digits. The mails sorted by the first-order digits, even if introduced to the overflow bins or stackers in the second sorting pass, are not disrupted in the order of serial number. In other words, the sorting operation by the second-order digit of overflown mails can be accomplished efficiently making full use of the distribution by the first-order digits.

Now, returning to FIG. 9A, explanation will be made about the succeeding sorting operation by second-order digits of the serial number. In step 116, the mails sorted by first-order digits are recovered in the order of the first-order digits of the serial number, and are loaded again into the loading port 2 of the sorter 1 automatically or manually. Step 117 sets the sorting mode in accordance with the bin or stacker number assigned in steps 111, 114 and executes the sorting operation of the sorter. Upon complete sorting operation by second-order digits, step 118 removes the mails from the overflow bins or stackers, and recovers the mails in the second-order digit bins or stackers A to R in the order of the serial number automatically or manually. Then, step 119 decides on the presence or absence of an overflow bin or stacker. In the case where the decision in step 119 is NO, the operation flow is terminated. In the case where the decision in step 119 is YES, on the other hand, the process is passed to the next step 120. Step 120 picks up the mails from the overflow bins or stackers OB1 and OB2 in the order of the serial number of the overflow bins or stackers, and load them again into the sorter. Step 121 sets the overflow bins or stackers S, T and U assigned for overflow to sections A, B and C, respectively, for example, and thus activates the sorter. Upon completion of this sorting operation, step 122 picks up the mails in the order of the bin or stacker number, and accumulates them following the mails recovered in step 118. All the mails thus can be rearranged in the order of serial numbers.

The above-mentioned embodiment of the invention represents only an example, to which the present invention is not limited. A recording medium for recording the program used to execute the process shown in FIGS. 9A and 9B is also included in the scope of the invention.

We claim:

1. An apparatus for loading a multiplicity of mails into a sorter controlled by a computer, causing said sorter to perform a plurality of sorting operations, and thus sorting and rearranging the mails in the sequence sorting, said apparatus comprising:

a delivery information list having recorded therein the delivery information including at least the sequence sorting and addresses;

a serial number list for storing serial numbers of a plurality of digits including at least serial numbers of first-order digits for a first sorting pass and serial numbers of the last-order digits including the serial number for a last sorting pass set in the sequence sorting corresponding to the delivery information list;

first sorting means for sorting the mails loaded in the sorter by the first-order digits of the serial number and accumulating the mails in separate bins or stackers;

a recognition section for recognizing the address of each mail when executing the sorting operation by said first sorting means;

a number-of-mails matrix table formed based on the serial numbers of a plurality of digits, in which the number of mails having the address recognized by said recognition section is counted at a position in said number-of-mail matrix table specified by a serial number corresponding to the address of said mail recognized by said recognition section;

means for reassigning the last-order digit of the serial number at least before the sorting operation by the last-order digit in such a manner as to prevent an overflow in any of the bins or stackers during the sorting operation according to the last-order digit, and second sorting means in which the mails sorted in advance of the last-order digit sorting operation are loaded in the sorter in the order of serial number and sorted in accordance with the last-order digit of the serial number reassigned by said reassignment means.

2. An apparatus for sorting and rearranging mails in the sequence sorting according to claim 1, wherein said serial number reassignment means includes:

means for calculating and recording in the total mail number column the total number of mails recorded in the number-of-mails matrix table at least for each column of the last-order digit of the serial number upon complete operation of said first sorting means; and assignment setting means for comparing the total number of mails in each of the total mail number column with the mail accumulation capacity of a sorting port, assigning one or a plurality of bins or stackers for each column of the last-order digit of the serial number in such a manner as to prevent the overflow of mails from said bin or stacker, assigning bin or stacker numbers to the assigned bins or stackers in the ascending order of the serial number having a plurality of digits and setting said bin or stacker numbers in said serial number list.

3. An apparatus for sorting and rearranging mails in the sequence sorting according to claim 1, further comprising:

means for assigning a plurality of the lowest-order ones of said reassigned serial numbers for overflow bins or stackers in order to reduce the actual number of bins or stackers at least by the number of extraneous serial numbers when the number of serial numbers reassigned by said serial number reassigning means exceeds the actual number of bins or stackers; and third sorting means for executing the sorting operation in accordance with the reassigned serial numbers on the mails stacked at the overflow bins or stackers after complete sorting operation by said second sorting means.

4. An apparatus for sorting and rearranging mails in the sequence sorting according to claim 2, wherein:

said assignment setting means includes means operating in such a manner that only when the total number of the bins or stackers assigned by said assignment means is larger than the number of actual bins or stackers, one or a plurality of bins or stackers smaller than the number of a plurality of the lowest-order bin or stacker of said assigned bins or stackers are set in said serial number list as the overflow bin or stacker, thereby preventing the overflow of mails during the sorting operation performed according to the last-order digit of the serial number.

5. An apparatus for sorting and rearranging mails in the sequence sorting according to claim 4, wherein:

said second sorting means executes the sorting operation in accordance with the last-order digit of the serial number reassigned by said reassignment means and said overflow bin or stacker number.

6. An apparatus for sorting and rearranging mails in the sequence sorting according to claim 5, further comprising:

third sorting means in which the mails stacked in the overflow bin or stacker among those mails sorted by said second sorting means are sorted in accordance with the lowest-order bin or stacker number.

7. An apparatus for sorting and rearranging mails in the sequence sorting according to claim 1, wherein:

said sorter sorts the mails by the cardinal number sorting method.

8. An apparatus for sorting and rearranging mails in the sequence sorting according to claim 1, wherein:

the product of the maximum values of each digit of a serial number having a plurality of digits is not less than the number of households intended for delivery.

9. A method of sorting and rearranging mails in the sequence sorting in which a multiplicity of mails are loaded in a sorter controlled by a computer, and said sorter performs a plurality of sorting operations for sorting and rearranging said mails in the sequence sorting, said method comprising the steps of:

registering a delivery information list having recorded therein the delivery information having at least the sequence sorting and addresses;

preparing a serial number list for storing at least the first-order digits of serial numbers for a first sorting pass and the last-order digits of the serial numbers for a last sorting pass, which serial numbers are set in the sequence sorting corresponding to said delivery information list;

sorting the mails loaded in said sorter by the first-order digits of said serial numbers and executing the first sorting pass in such a manner that the mails are stacked in separate bins or stackers according to the result of sorting;

recognizing and reading the address of each mail in the process of executing the first sorting pass;

preparing a number-of-mails matrix table on the basis of a serial number having a plurality of digits;

attaching a count representing the number of mails having an address recognized by said recognition step at a position in said number-of-mails matrix table specified by said serial number having a plurality of digits corresponding to said address;

reassigning the last-order digit of the serial number at least before executing the sorting operation by the last-order digit in such a manner as not to cause any overflow in any bin or stacker during said sorting operation by the last-order digit; and executing the second sorting pass on the mails sorted before the sorting operation performed by the last-order digit, in accordance with the last-order digit of the serial number reassigned in said reassignment step.

10. A method of sorting and rearranging mails in the sequence sorting according to claim 9, in which said serial number reassignment means includes the steps of:

calculating and recording in the total mail number column the number of mails recorded in the number-of-mails matrix table at least for each column of the last-order digits of the serial number in said number-of-mails matrix table after complete operation of said first sorting pass, and comparing the total number of mails in each of total mail number columns with the number of mails stacked in each of said bins or stackers, assigning one or a plurality of bins or stackers to each column of the last-order digit of the serial number in such a manner as to prevent the overflow of said mails from said bins or stackers, and assigning a bin or stacker number having a plurality of digits to each of said assigned bins or stackers in the ascending order, said assigned bin or stacker numbers being set in said serial number list.

11. A method of sorting and rearranging mails in the sequence sorting according to claim 9, further comprising the steps of:

assigning a plurality of the reassigned highest-order serial numbers for the overflow bins or stackers in order to reduce the actual number of bins or stackers at least by the number of the extraneous serial numbers in the case where the number of serial numbers reassigned in said serial number assignment step exceeds the actual number of bin or stacker, and executing a third sorting pass in accordance with the reassigned serial numbers on the mails stacked in said overflow bin or stacker after completion of said second sorting pass.

12. A method of sorting and rearranging mails in the sequence sorting according to claim 10, in which said assignment step includes the step of:

step of setting in said serial number list one or a plurality of overflow bin or stacker numbers fewer than and from among a plurality of the highest-order bin or stacker numbers only in the case where the total number of bins or stackers assigned in said assignment step is larger than the actual number of bins or stackers, thereby preventing the overflow of mails during the sorting operation performed by the last-order digit of the serial numbers.

13. A method of sorting and rearranging mails in the sequence sorting according to claim 12, in which said second sorting pass includes the step of:

executing the sorting operation in accordance with the overflow bin or stacker number and the last-order digit of the serial number reassigned in said reassignment step.

14. A method of sorting and rearranging mails in the sequence sorting according to claim 13, further comprising a third sorting pass including the step of:

executing the sorting operation in accordance with the highest-order bin or stacker number on the mails sorted in said second sorting pass and stacked in said overflow bin or stacker.

15. A processor readable medium storing program code for causing a computer to sort mails, in which a multiplicity of mails are loaded in a sorter controlled by a computer, and said sorter performs a plurality of sorting operations thereby to sort and rearrange mails in the sequence sorting, said program including the program codes for executing the steps of:

registering a delivery information list having recorded therein the delivery information having at least the sequence sorting and addresses;

preparing a serial number list for storing serial numbers with a plurality of digits having at least the first-order digit of the serial number for a first sorting pass and the last-order digit of the serial number for a last sorting pass set in the sequence sorting corresponding to said delivery information list;

performing the first sorting pass in such a manner as to sort said mails loaded in said sorter by the first-order digit of the serial numbers and accumulating said mails in separate bins or stackers as the result of sorting;

recognizing and reading the address of each mail when executing said first sorting pass;

preparing a number-of-mails matrix table based on said serial numbers having a plurality of digits;

attaching a count of the number of mails having said address at a position in said number-of-mails matrix table specified by said serial number having a plurality of digits corresponding to the address of said mail recognized in said recognition step;

reassigning the last-order digit of the serial number at least before the sorting operation by the last-order digit in such a manner as to prevent an overflow in any bin or stacker during said sorting operation by the last-order digit; and executing the second sorting pass on the mails sorted prior to said the sorting operation by the last-order digit, in the order of the last digit of the serial number reassigned in said reassignment step, by loading said mails into said sorter according to the result of said prior sorting operation.

* * * * *